US005096318A

United States Patent [19]

Susini et al.

[11] Patent Number: 5,096,318

[45] Date of Patent: Mar. 17, 1992

[54] DEVICE FOR ROTATIONAL BRAKING BETWEEN TWO CONCENTRIC MEMBERS

[75] Inventors: Claude Susini, Seenecey le Grand; Pascal Mejean, Veyrier du Lac, both of France

[73] Assignee: Reboul-SMT, Creteil, France

[21] Appl. No.: 642,332

[22] Filed: Jan. 17, 1991

[30] Foreign Application Priority Data

Jan. 19, 1990 [FR] France ..... 90 00600

[51] Int. Cl.[5] ..... A45D 40/12; A45D 40/06

[52] U.S. Cl. ..... 401/80; 401/68; 401/75; 401/78

[58] Field of Search ..... 401/80, 78, 75, 68

[56] References Cited

U.S. PATENT DOCUMENTS

| | | | |
|---|---|---|---|
| 2,022,075 | 11/1935 | Cabrera | 401/78 |
| 3,380,795 | 4/1968 | Gruska | 401/78 |
| 3,620,632 | 11/1971 | Gruska | 401/78 |
| 4,812,066 | 3/1989 | Gueret | 401/78 |
| 4,813,801 | 3/1989 | Cardia | 401/78 X |

FOREIGN PATENT DOCUMENTS

| | | | |
|---|---|---|---|
| 507719 | 6/1955 | Italy | 401/78 |
| 506428 | 5/1939 | United Kingdom | 401/78 |
| 1118889 | 7/1968 | United Kingdom | 401/80 |

*Primary Examiner*—Steven A. Bratlie

*Attorney, Agent, or Firm*—Finnegan, Henderson, Farabow, Garrett & Dunner

[57] ABSTRACT

Device comprising a collar (10*a*) whose annular base, fixed to the inner member (4*a*), is extended by a plurality of lugs (9*a*) which are resiliently deformable radially and whose free ends come into frictional contact within a cylindrical bearing solidly attached to the outer member (6*a*).

12 Claims, 2 Drawing Sheets

DEVICE FOR ROTATIONAL BRAKING BETWEEN TWO CONCENTRIC MEMBERS

The present invention relates to light mechanical engineering, more particularly in the field of packaging, in rotating cases, substances in stick form such as cosmetic products, particularly lipstick, pharmaceutical products, adhesives and domestic care products.

In rotating cases of the lipstick mechanism type, it is desirable to introduce rotational braking means in order to avoid untimely displacements of the stick during its use or in the course of transport. To achieve this, use is made of localised frictional effects between the two concentric sheaths with the interposition of a compressed free ring, as described in French Patent No. 1,417,277, with deformation of the sheaths or friction of the stick-carrying travelling cup against the sheath which surrounds it, as described in French Patent No. 1,501,043. These conventional solutions exhibit disadvantages, in particular irregular efficiency deriving both from the moulding tolerances of the sheaths and of the travelling cup, and from the nature of the plastic in which they are moulded, the choice whereof is imposed by mechanical constraints to which they are subjected and by their ease of moulding in mass production and their cost.

The object of the invention is to remedy the disadvantages of the conventional braking means by virtue of a flexible device interposed between two concentric rotating members, to compensate for differences in play and possible ovalisations. Of small dimensions, it can be produced in a material of appropriate specific mechanical properties, which may if appropriate be more costly than that of the rotating members, without adversely affecting the cost price of the whole. Its manufacture and assembly in mass production present no particular difficulty. Moreover, the efficiency of the braking can be adaptable to each case considered, with a single standardised device.

The subject of the invention is a device for rotational braking between two concentric members, characterised in that it comprises a collar whose annular base is extended by a plurality of lugs which are resiliently deformable radially and the free ends of which come into frictional contact within a cylindrical bearing solidly attached to the outer member, the base of the collar being fixed to the inner member.

According to various advantageous design embodiments:

each of the flexible ends of the lugs may possess, towards the outside, a swelling forming a friction means;

the inner member may possess an outer annular bearing limiting the centripetal movement of the lugs over part of their length, from the base, and bending them outwards if appropriate;

the base of the collar may be fixed on the inner member by snap-fitting of at least one annular protrusion on the one into a complementary groove on the other;

at least two axially offset grooves may be presented to at least one protrusion;

similarly, at least two axially offset annular protrusions may be presented to at least one groove;

the corresponding protrusion and groove may be of frustoconical shape, widening towards the lugs;

the base of the collar may be keyed for rotation on the inner member by the association of at least one axis-parallel rib on the one inserted into a corresponding groove on the other;

at least some lugs are divisible at their base, as required;

the material of the collar may be of a different hardness from that of the bearing of the outer member.

the invention also relates to a case for lipstick or other product in stick form, having a rotary mechanism for the axial translatory movement of the stick carried by a cup possessing radial pins interacting with a double helical groove cut in a sheath and with a longitudinal slot in another sheath which is concentric and undergoes relative rotation, which case is characterised in that it comprises a braking device whose collar is fixed to the base of the inner sheath of the case, the lugs making frictional contact with the inside of a marginal portion of the base of the outer sheath or of an outer sleeve solidly attached to the outer sheath and prolonging the latter.

The invention will be more readily understood by examining, and reading the detailed description of, the attached drawings which show two embodiments of the invention, selected merely by way of example from the numerous embodiments, adaptations and alternative forms of the invention which are accessible to a person skilled in the art.

In these drawings.

In these figures, corresponding elements are designated by the same reference numerals, together with an index if appropriate. The respective dimensions and proportions of these elements may be inaccurately reproduced in order to render the drawings more legible.

Figure 1:
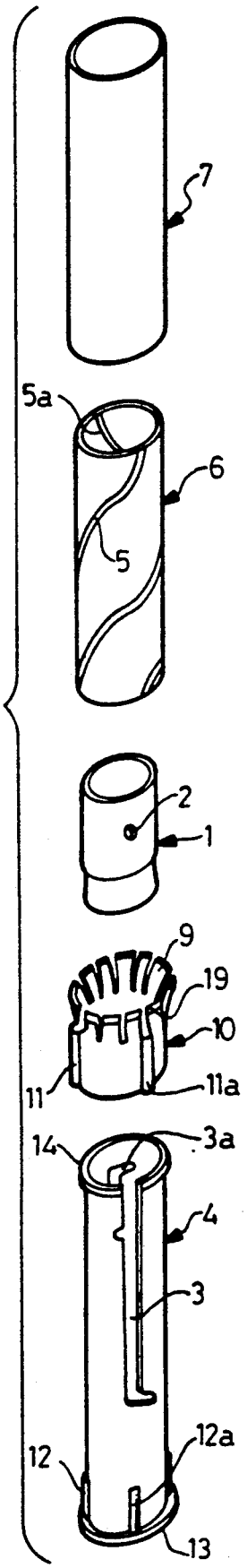
FIG. 1 is a diagrammatic view, in exploded perspective, of a first embodiment of a lipstick case according to the invention.
Figure 2:
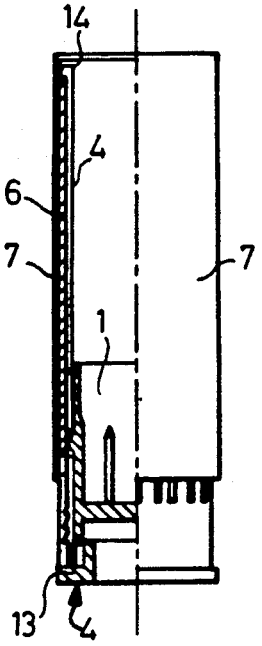
FIG. 2 is a diagrammatic view, in elevation and half in axial section, of the case shown in FIG. 1.
Figure 3:
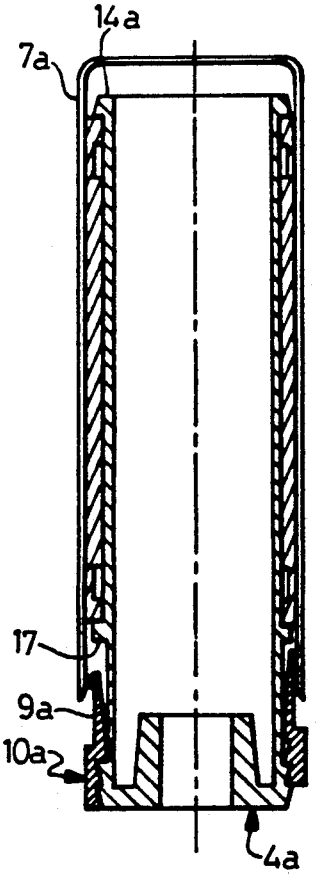
FIG. 3 is a diagrammatic view, in elevation and in axial section, of a second embodiment of a lipstick case according to the invention, the right-and left-hand halves of which represent two arrangements of the braking collar corresponding to two different braking values.
Figure 4:
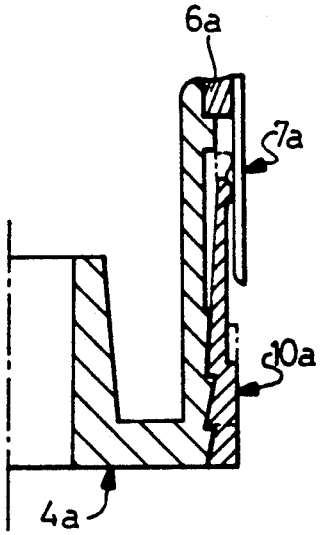
FIG. 4 is a diagrammatic detailed view, on a larger scale, in elevation and axial section, of the braking device which can be adapted to the case shown in FIG. 3.
Figure 5:
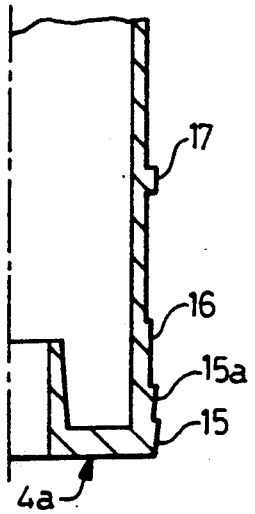
FIG. 5 is a diagrammatic view, in elevation and axial section, of the base of the inner member of the case shown in FIG. 3.
Figure 6:
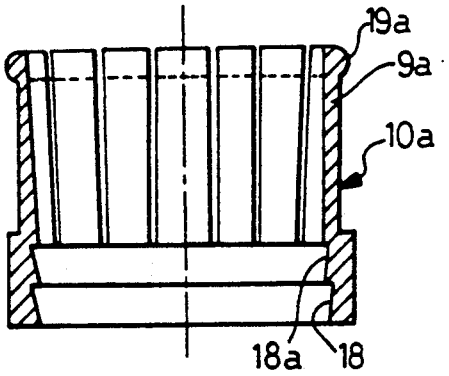
FIG. 6 is a diagrammatic view, in elevation and in axial section, of the collar of the case shown in FIG. 3.
Figure 7:
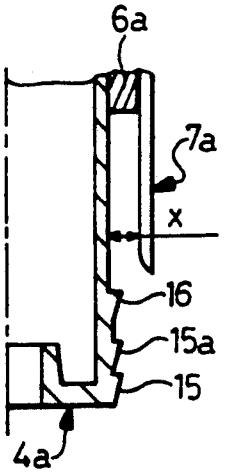
FIG. 7 is a diagrammatic view, in elevation and in axial half-section, of the two rotary members of the case shown in FIG. 3.
Figure 8:
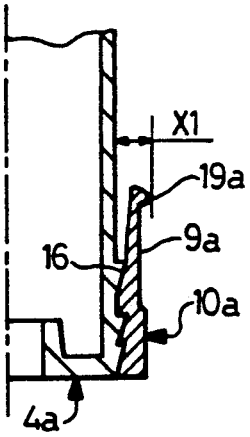
FIG. 8 is a diagrammatic view, in elevation and in axial half-section, of a first arrangement of the collar and of the base of the inner member of the case shown in FIG. 3, for gentle braking.
Figure 9:
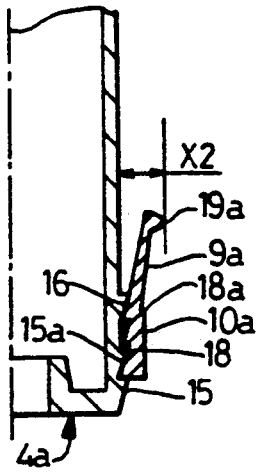
FIG. 9 is a view analogous to that shown in FIG. 8 of a second arrangement for stronger braking.

The lipstick case shown in FIGS. 1 and 2 essentially comprises a stick-carrying travelling cup 1 for lipstick, possessing two radial pins 2 which slide, through longitudinal slits 3, 3*a* in an inner tubular sheath 4, in helical grooves 5, 5*a* of an outer sleeve 6 fixedly attached to an open outer tubular case 7. The sleeve 6 rotates freely about the sheath 4, and the base of the case 7 overlaps below the base of the sleeve 6, and thus providing an annular space and forming a smooth cylindrical bearing for the friction of the distended ends 19 of lugs 9 which are bent resiliently outwards and radially deformable, emerging from the base of a collar 10, fitted about the base of the sheath 4, as shown in FIG. 2. The base of the collar 10 possesses longitudinal grooves 11, 11*a* which interact with ribs 12, 12*a* of the base of the sheath 4 to key the collar 10 for rotation on the inner sheath 4. An annular rim 13 of the end of the sheath 4 fixes the collar 10 axially. At the other end of the sheath 4, another annular rim 14, which is split, fits resiliently onto the corresponding end of the sleeve 6 to fix it axially, interacting with the ends 19 of the lugs 9, in opposition.

Thus, when the various elements of FIG. 1 are assembled, as shown in FIG. 2, and when the sheath 4 is rotated relative to the sleeve 6, the cup 1 is axially displaced in the grooves 3, 3*a*, the collar 10 is driven by the sheath 4 and the distended outer ends 19 of its lugs 9 come into frictional contact resiliently with the inside of the base of the case 7, fixedly attached to the sleeve 6, thus creating a gentle and regular friction which is virtually insensitive to the customary dimensional differences and ovalisations which are inevitable in mass-produced mouldings.

If a reduced friction is desired, all that is necessary is to break some of the lugs 9, preferably evenly distributed, at their bases.

The sheath 4 and the sleeve 6 may advantageously be moulded from polystyrene or polypropylene, the cup 1 from polystyrene, the collar 10 from acetal resin, and the case 10 from polystyrene. It is of course possible to use any other suitable known plastic, and the properties of these plastics may be modified by the addition of conventional fillers such as silicon, fibre glass, molybdenum sulphate, glass microspheres, or polytetrafluoroethylene, especially in order to improve or reduce their resistance to friction or their elasticity. The case 7 may also be produced from metal, particularly light alloy or copper alloy.

The second embodiment of the lipstick case shown in FIGS. 3 to 9 comprises the same elements as that in FIGS. 1 and 2; an inner sheath 4*a*, a sleeve 6*a*, a case 7*a* and a collar 10*a*. To simplify the drawing, the stick-carrying travelling cup analogous to the cup 1 in FIGS. 1 and 2 has not been shown.

This second embodiment of FIGS. 3 to 9 differs from that in FIGS. 1 and 2 in that the base of the sheath 4*a* exhibits two annular ribs 15, 15*a*, of triangular section, widening from the end of the base of the sheath 4 and axially offset from one another, and an annular bearing 16. An annular rib 17 interacts with the opposite rim 14*a* of the sheath 4*a* to keep the sleeve 6*a* in free rotation, keyed axially about the sheath 4*a*. Ribs 15, 15*a* of the base of the sheath 4*a* interact by snap fitting with the internal grooves 18, 18*a* of the base of the collar 10*a* in order to fix the collar of the sheath according to two positions shown in FIGS. 8 and 9 and indicated respectively in solid lines and broken lines in FIG. 4.

When the collar 10*a* is moved slightly over the base of the sheath 4*a*, the two ribs 15, 15*a* being engaged in the grooves 18, 18*a* (FIG. 8), its lugs 9*a* are pushed radially outwards by the bearing 16 to only a slight extent, if at all, and their free ends 19*a* are radially distanced from the outer wall of the sheath 4*a* by a distance x1 which is slightly greater than the distance x (FIG. 7) separating the outer wall of the sheath 4*a* from the inner wall of the case 7*a*, which brings about gentle braking.

By contrast, when the collar 10*a* is moved further onto the base of the sheath 4*a*, the rib 15*a* alone being engaged with the groove 18 (FIG. 9), and the base of the lugs being relatively distant from the bearing 16, the lugs 9*a* are pushed radially outwards by the bearing 16 to a distance x2, greater than the distance x1, which brings about a stronger braking, the lugs 9*a* bearing more strongly on the inner wall of the base of the case 7*a*.

Thus, with the same components, a simple mechanical adjustment to move the collar a longer or a shorter distance onto the base of the sheath during assembly of the components makes it possible to obtain, as desired, gentler or stronger braking of the rotation of the sheath 4*a* in the sleeve 6*a*.

The elasticity of the lugs of the collar and, consequently, the intensity of the braking also depend on the free length of the lugs, the short lugs being more rigid than the long lugs, but also on the size of their cross-section, and additionally on the width of their bearing surface.

A braking mechanism according to the invention requires no lubrication, which is an advantage as compared with conventional mechanisms.

We claim:

1. A case for lipstick or other produce in stick form comprising:

(a) an outer tubular sleeve having at least one helical groove therein extending along the length thereof;

(b) a cylindrical bearing solidly attached to said outer sleeve;

(c) an inner tubular sheath concentric with and rotatably positioned inside said outer sleeve and having a longitudinal slot therein and a base portion;

(d) a travelling cup member inside said inner sheath for carrying a stick-form product, said cup member having at least one radially-extending pin for interacting with said helical groove to provide axial translatory movement of said cup member when said inner sheath is rotated in said outer sleeve;

(e) a collar member affixed to said base portion of said inner sheath, said collar member having a base portion and a plurality of lugs extending from the base portion thereof, said lugs being resiliently deformable radially and having free outer ends in frictional and rotational contact with said cylindrical bearing to provide rotational braking between said inner sheath and said outer sleeve.

2. The case of claim 1, wherein said free outer ends of said lugs are enlarged and provide frictional contact with said cylindrical bearing.

3. The case of claim 1, further including at least one complementary annular bearing extending radially outward from said base portion of said inner sheath for limiting the centripetal movement of said lugs.

4. The case of claim 3, wherein at least one annular groove is provided on one of said base portions and at least one annular protrusion is provided on the other of said base portions for snap-fitting into said annular groove.

5. The case of claim 4, wherein there are at least two axially spaced annular protrusions on said other base portion, each of which may be snap fitted into a complementary annular groove in said one base portion.

6. The case of claim 4, wherein there are at least two axially spaced annular grooves on said one base portion for receiving a complementary annular protrusion on said other base portion.

7. The case of claim 4, wherein said annular groove and said annular protrusion each are of a frustoconical shape, widening toward said lugs.

8. The case of claim 3, wherein there is a plurality of axially spaced annular bearings extending radially outward from said inner sheath, each for pushing said lugs radially outward from differing distances from said inner sheath as said collar member is moved axially on said inner sheath so as to enable a varying rotational braking force between said inner sheath and said outer sleeve.

9. The case of claim 1, further including at least one axis-parallel rib on the base portion of one of said inner sheath and said collar and at least one groove on the base portion of the other of said inner sheath and said collar, said rib being insertable into said groove to key said collar for rotation on said inner sheath.

10. The case of claim 1, wherein said lugs are spaced from one another around the base portion of said collar member.

11. The case of claim 1, wherein said collar member is formed of a material having a hardness different from that of said cylindrical bearing.

12. The case of claim 1, wherein said outer sleeve has a double helical groove therein and said cup member has a plurality of said radially-extending pins.

* * * * *

UNITED STATES PATENT AND TRADEMARK OFFICE

CERTIFICATE OF CORRECTION

PATENT NO. : 5,096,318

DATED : March 17, 1992

INVENTOR(S) : Claude Susini and Pascal Mejean

It is certified that error appears in the above-identified patent and that said Letters Patent is hereby corrected as shown below:

Title page, Inventors, item [75] change "Seenecey" to --Sennecey--.

Claim 1, column 4, line 26, change "produce" to --product--.

Signed and Sealed this

Seventh Day of September, 1993

Bruce Lehman

*Attest:*

BRUCE LEHMAN

*Attesting Officer*

*Commissioner of Patents and Trademarks*